United States Patent [19]

Koblick

[11] 4,133,528

[45] Jan. 9, 1979

[54] ILLUMINATED GAME BALL

[75] Inventor: Jeffrey Koblick, Hopkins, Minn.

[73] Assignee: K-tel International, Inc., Minnetonka, Minn.

[21] Appl. No.: 800,208

[22] Filed: May 25, 1977

[51] Int. Cl.[2] ..... A63B 43/06

[52] U.S. Cl. ..... 273/65 EF; 46/228; 362/390

[58] Field of Search ..... 46/228, 230; 273/58 G, 273/65 EF; 362/253, 369, 390

[56] References Cited

U.S. PATENT DOCUMENTS

| | | | |
|---|---|---|---|
| 2,616,215 | 11/1952 | Martial et al. | 46/228 |
| 2,696,382 | 12/1954 | Gelardin | 46/228 X |
| 2,726,483 | 12/1955 | Hughes et al. | 46/228 |
| 3,229,976 | 1/1966 | Allen | 46/228 X |
| 4,002,893 | 1/1977 | Newcomb et al. | 46/228 X |

*Primary Examiner*—George J. Marlo

*Attorney, Agent, or Firm*—Allegretti, Newitt, Witcoff & McAndrews

[57] ABSTRACT

In a translucent play ball, an improvement of apparatus for illuminating the play ball utilizes batteries and a lamp. The apparatus includes three compressible helical springs and a translucent casing for encapsulating the batteries, lamp and springs. The springs are compressed within the casing in contact with one another. The lamp is secured to an end of the middle spring, which also encircles the batteries. The spring to the side away from the lamp holds the batteries in contact with the lamp and itself contacts the batteries. A series circuit is thus completed through the batteries to the springs and back to the lamp. In modified forms, the casing has removable and locking end caps and a switch for switching off the lamp by decompressing the springs.

13 Claims, 15 Drawing Figures

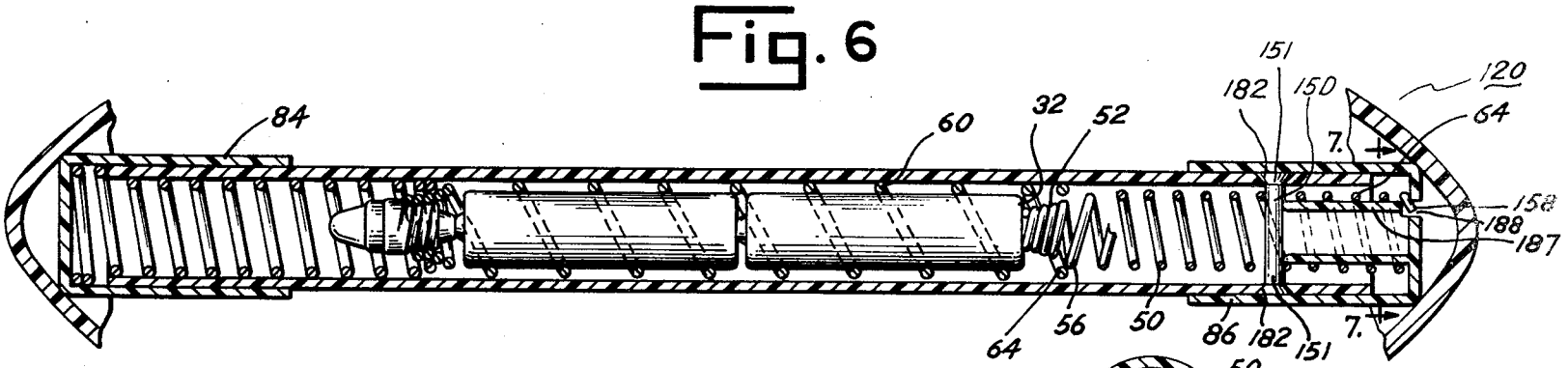
Fig. 6
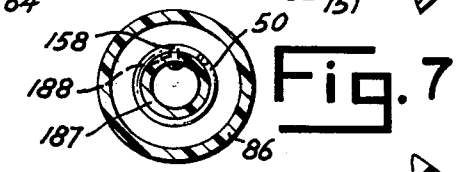
Fig. 7
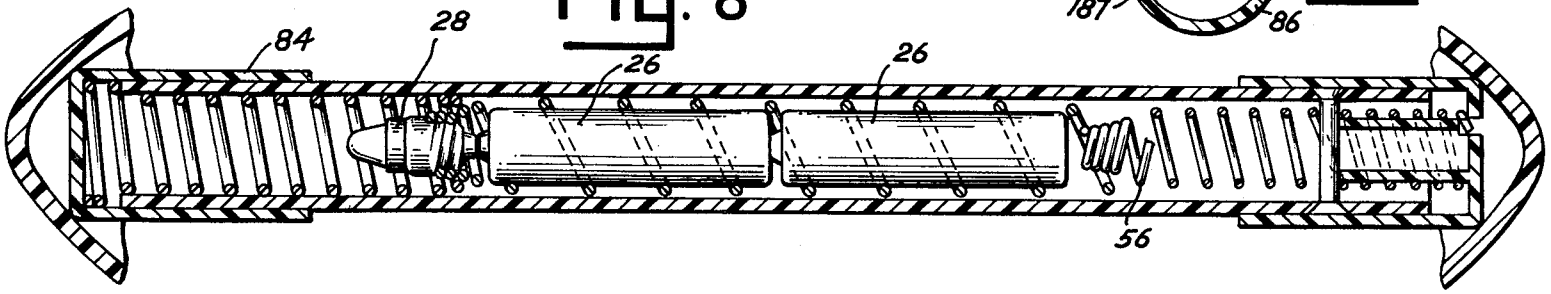
Fig. 8
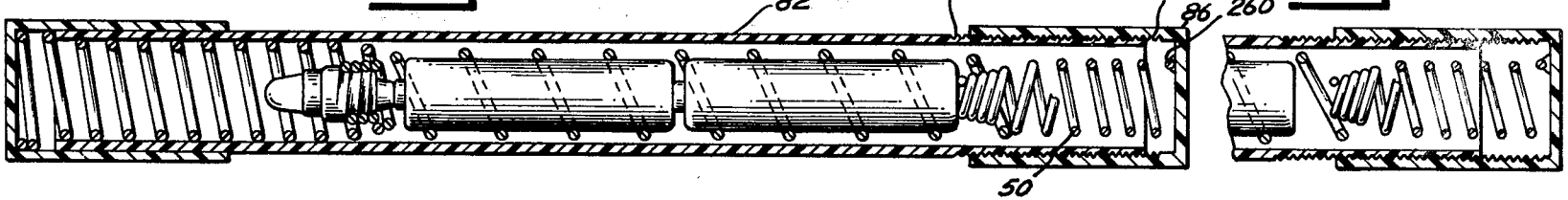
Fig. 9
Fig. 10

360
50
86
386
382
320
82

82
362
372
13.
13.
374
374
15.
15.
84

82
372
14.
14.

82
372

84
374
374

ILLUMINATED GAME BALL

BACKGROUND OF THE INVENTION

The present invention relates to toys and, more specifically, to apparatus for illuminating a translucent play ball.

A great number of games, both outdoor and indoor, require a ball. However, such games are limited to daylight hours or lighted areas after dark, because a ball that is not visible in the dark may become lost or cause injury to a player.

The prior art suggests that there has been a need for an acceptable self-illuminated play ball. A difficulty encountered by manufacturers of play balls constructed to meet this need relates to the construction of satisfactory illumination apparatus. Reliability during rough and tumble play is essential. Equally critical to successful commercialization are two other requirements; namely, easy maintenance of the bulb and batteries, and pleasing, uniform illumination of the ball. The apparatus should also include a switch. However, none of these requirements should be satisfied by sacrificing balance, simplicity or lightness of weight. Prior art devices satisfy some of the criteria, but there remained a long felt need for illumination apparatus that satisfies all the criteria simultaneously.

SUMMARY OF THE INVENTION

In a principal aspect, the present invention relates to an improvement in a translucent play ball of apparatus for illuminating the play ball. The apparatus utilizes at least one battery having two electrical battery terminals and a lamp having two electrical lamp terminals, and includes first, second, and third compressible helical springs positioned in serial order in a translucent casing which also encapsulates the lamp and battery. The casing has opposed end pieces which compress the springs. The lamp and the battery are connected in an electrical series circuit through the first and second springs. That is, the first spring contacts one of the battery terminals, while the second spring secures the lamp and simultaneously contacts one of the lamp terminals. The other lamp terminal contacts the other battery terminal, and the second spring also simultaneously contacts the first spring.

In modified forms of the invention, the apparatus further comprises a switch for connecting and disconnecting the series circuit. The switch acts to decompress the springs, thereby taking the battery out of contact with the first spring.

It is thus an object of the present invention to provide an improvement in a play ball of apparatus for illuminating the play ball, which utilizes a lamp and batteries.

Another object of the present invention is to provide apparatus suitable for rough and tumble play.

Still another object is to provide apparatus which protects the lamp from breakage by cushioning it from shocks during play.

A further object is to provide apparatus which supplies pleasing, uniform illumination to the play ball.

Still further objects are to provide simple, balanced, compact and light weight apparatus, which is designed for easy maintenance of bulb and batteries, and which contains a switch for long bulb and battery life.

These and other objects and advantages of the present invention will become apparent from a description of the preferred embodiment of the invention, which follows.

BRIEF DESCRIPTION OF THE DRAWING

In the detailed description which follows, reference will be made to drawing, wherein:

FIG. 6 is a longitudinal cross-sectional view of the embodiment of FIG. 5, taken along line 5—5 of FIG. 5;

FIG. 7 is a cross-sectional view of the embodiment of FIG. 5, taken along line 7—7 of FIG. 6;

FIG. 8 is an enlargement of the view of FIG. 5, depicting the switch in the disengaged state;

FIG. 9 is a longitudinal cross-sectional view of a second modified embodiment of the present invention having a modified switch, depicted in the engaged state;

FIG. 10 is a broken longitudinal cross-sectional view of the embodiment of FIG. 9, depicting the switch in the disengaged state;

DESCRIPTION OF THE PREFERRED EMBODIMENT

Figure 1:
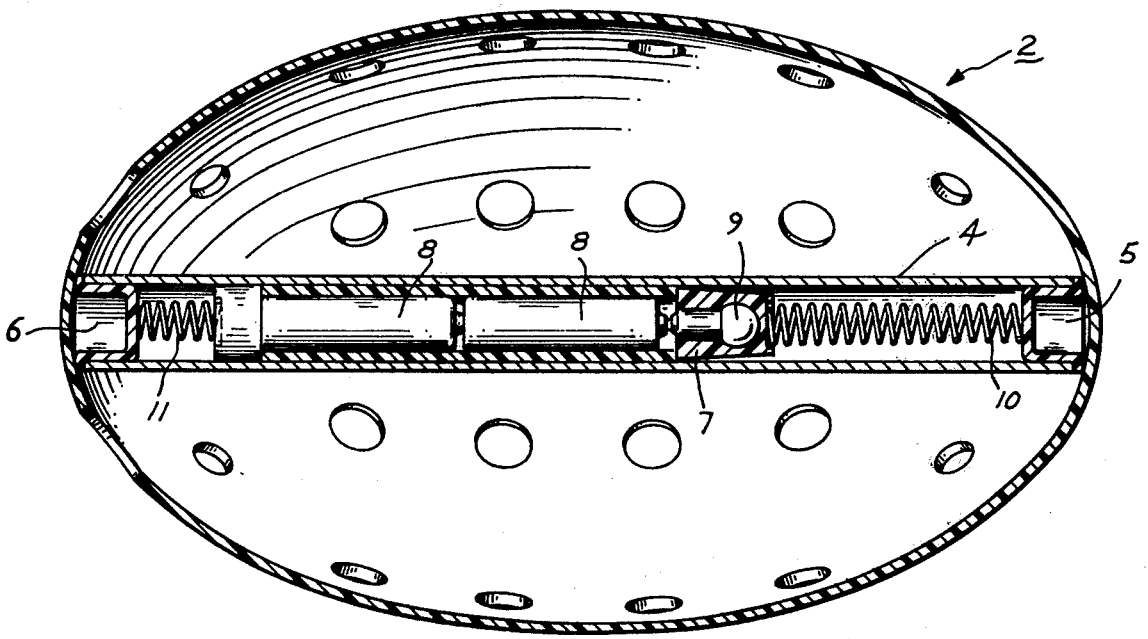
Fig. 1 PRIOR ART
FIG. 1 is a longitudinal cross-sectional view of a prior art device.

Referring to the drawing as it relates to the prior art, the device developed by Nelson F. Newcomb and Nelson F. Newcomb, Jr. is depicted in FIG. 1 as device 2. Device 2 includes a play ball 3, a tube 4 with caps 5 and 6, a flashlight unit 7 containing batteries 8 and lamp 9, and two springs 10 and 11. Flashlight unit 7 slides along tube 4 and is cushioned by springs 10 and 11.

Figure 2:
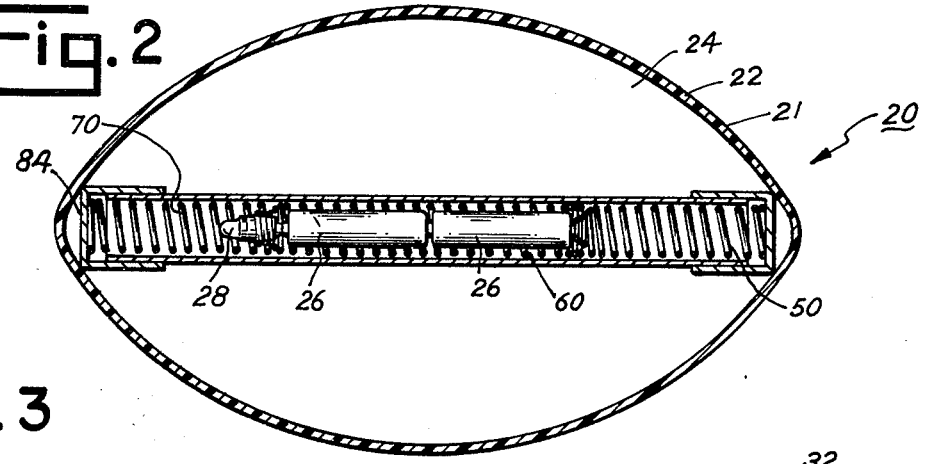
FIG. 2 is a longitudinal cross-sectional view of a preferred embodiment of the invention.

Referring now to the drawing as it relates to the present invention, a preferred embodiment of the present invention is shown and generally depicted as an apparatus 20 in FIG. 2. As noted above, apparatus 20 is designed for illuminating a play ball, the play ball 21 having translucent walls 22 defining a hollow interior 24. Batteries 26 and a lamp 28 are utilized by the apparatus 20, and the apparatus comprises a first compressible helical spring 50, a second compressible helical spring 60, a third compressible helical spring 70, and a casing 80. The batteries 26, lamp 28, first helical spring 50, second helical spring 60, and third helical spring 70 are encapsulated by casing 80.

Figure 3:
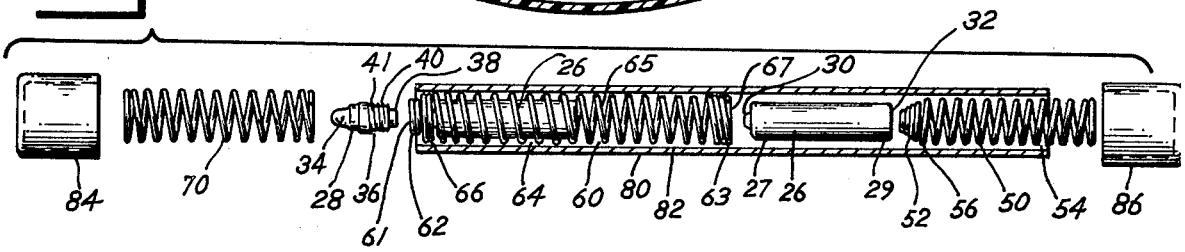
FIG. 3 is an exploded view of the embodiment shown in FIG. 2, in which only the casing cylinder of FIG. 2 is shown in cross-section.

Referring now to FIG. 3, batteries 26 are shown and are of a type commercially available, having a generally cylindrical shape and opposed ends 27 and 29, with a knob-like positive electrical battery terminal 30 on end 27 and a disc-shaped negative electrical battery terminal 32 on end 29. Any number of batteries 26 may be used, depending on the electrical power suitable for lamp 28.

Also shown in FIG. 3 is lamp 28, which is also of a type commercially available, having a bulb 34 and a body 36 with a knob-like electrical lamp terminal 38 and circumferential male screw threads 40 forming the second electrical lamp terminal 41 thereof.

Referring again to FIG. 3, first helical spring 50, second helical spring 60 and third helical spring 70 are shown positioned in serial order, with longitudinal axes aligned, first helical spring 50 being to the right, second helical spring 60 being to the left of first helical spring 50, and third helical spring 70 being to the left of second helical spring 60.

First helical spring 50 is formed of suitable electrically conductive material such as steel spring wire, and has an end portion 52, a body portion 54 and a shoulder portion 56 therebetween. End portion 52 is adapted to be engageable against disc-shaped negative electrical terminal 32 of battery 26.

Second helical spring 60 is also made of suitable electrically conductive material and has ends 62 and 63, a body portion 64 and a shoulder portion 66 between end 62 and body portion 64. Body portion 64 defines a hollow cylindrical space 65 shown in FIG. 4, for receiving batteries 26, and spring 60 has an uncompressed length greater than the combined lengths of all the batteries 26 to be used. End 63 defines a first opening 67 into hollow cylindrical space 65, and end portion 52 of helical spring 50 is adapted to make contact with battery terminal 32 of battery 26 in space 65 through first opening 67. End portion 62 of second helical spring 60 is wound to mate with circumferential male threads 40 of lamp 28 for removably securing lamp 28 in an operating position, and defines a second opening 61 into hollow cylindrical space 65, lamp terminal 38 making contact with battery terminal 30 of battery 26 in hollow cylindrical space 67 through second opening 61.

Third helical spring 70 is adapted to encircle lamp 28 and end 62 of spring 60, and need not be electrically conductive since it forms no part of the electrical circuit between lamp 28 and batteries 26, in the preferred embodiment. However, third spring 70 may be electrically conductive and if so made, will not adversely affect the electrical operation of the apparatus.

Figure 4:
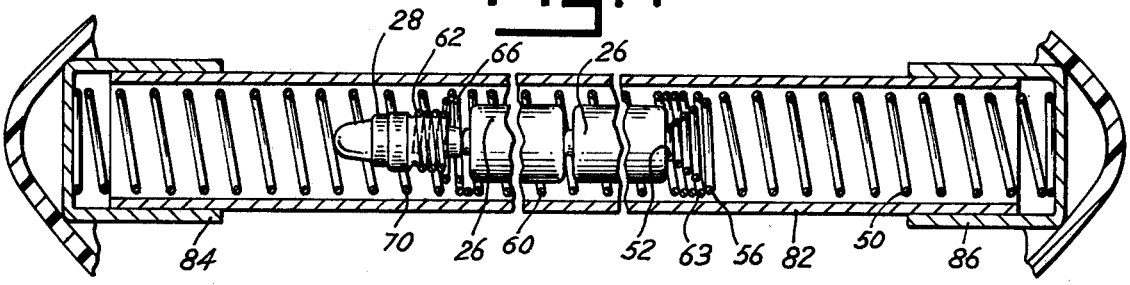
FIG. 4 is an enlarged and partial cross-sectional view of the embodiment of FIG. 2.

The final element of the preferred embodiment is shown in FIG. 3, translucent casing 80. Casing 80 is preferably made of electrically insulating material, such as plastic. Casing 80 may be suitably formed in one or more pieces, but in the preferred embodiment, casing 80 includes casing cylinder 82 and end caps 84 and 86. Casing cylinder 82 is chosen of a length suitable for compressing springs 50, 60 and 70 to the extent that batteries 26 make electrical contact with each other and with lamp 28 and end portion 62 of second spring 60, as shown in FIG. 4. Since lamp 28 is mounted on second spring 60, and since shoulder 56 of first spring 50 is adapted to contact second spring 60, placing end caps 84 and 86 on suitably chosen cylinder 82 cmpresses the springs and completes a circuit from lamp 28 through springs 50 and 60 to batteries 26 and back, thus lighting lamp 28, which will glow through translucent casing 80. With apparatus 20 installed within a ball by means of an open access hole or a screw-on access door or the like, the walls 22 of the ball will be illuminated to a pleasing brightness and uniformity.

For extreme economy of construction, springs 50, 60 and 70 may be formed from common spring wire, wound to identical shapes. In the preferred embodiment, the springs are formed from common spring wire, body portion 54 of spring 50 having an outer diameter equal to that of body portion 64 of spring 60 and that of spring 70. The active coils of all three springs are wound to a common helix in the preferred embodiment, for simplicity and economy of construction. The result of this construction is that all three springs have the same spring constant. Furthermore, the applicant has chosen to make all three springs of substantially the same length. However, any combination of lengths and spring constants would be suitable, so long as lamp 28 may not suffer shock damage or strike end cap 84 of casing 80 under shock loading and so long as second spring 60 may be compressed by casing 80 for allowing the series circuit to be completed. Also, if end caps 84 and 86 are friction fit, as in the preferred embodiment, the friction fit must not be overcome by the force of the springs.

The applicant has also chosen to use square and unground end turns on all three springs for economy of construction, but any suitable design is acceptable, so long as the three springs may abut one another. Finally, lateral buckling of the springs is avoided in the preferred embodiment because casing cylinder 82 has an inner diameter substantially equal to, but greater than, the outer diameter of body portion 54 of spring 50, the body portion 64 of spring 60 and spring 70. If it is desired to vary the diameters of springs 50, 60 and 70, the inner diameter of casing 80 can also be varied, to retain its function of preventing lateral buckling.

Referring now to FIGS. 5–8, 9–10, and 11–15, first, second and third modified forms of the preferred embodiment of the present invention are shown, respectively. The first and second of these modifications include a switch for switching the lamp on and off without fully loosening the end caps, and the third includes a lock for locking a removable end cap in place.

Figure 5:
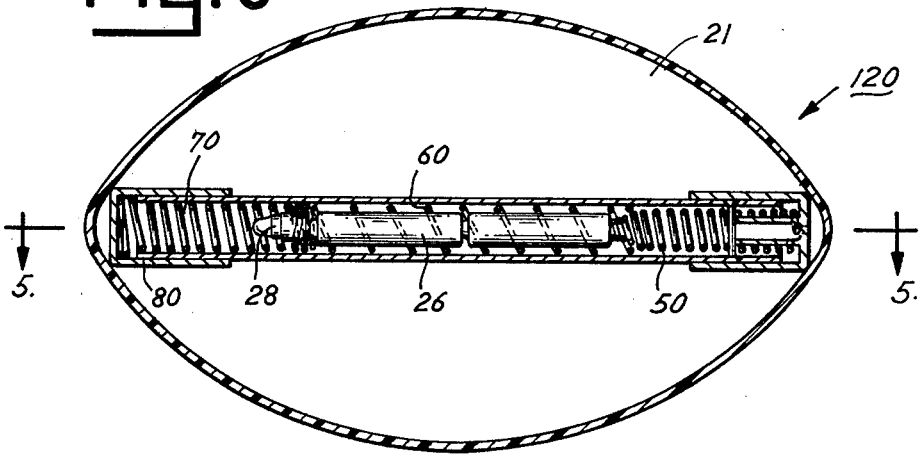
FIG. 5 is a longitudinal cross-sectional view of a modified embodiment of the invention, having a switch, with the switch shown in the engaged state.

Shown in FIG. 5 is the first modified form of the preferred embodiment, generally depicted at 120 having all the components and associated features described in relation to FIGS. 2–4. As most clearly shown in FIG. 6, first modified form 120 includes an end cap 86 which has a cylindrical inner member 187 formed as an integral part thereof. Inner member 187 is adapted to be encircled by body portion 54 of first spring 50. End cap 86 also has aperture 188 as shown in FIGS. 6 and 7, and end 158 of first spring 50 is formed to fit within aperture 188 to secure spring 50 for rotation with end cap 86. Casing cylinder 82 has diametrically opposed tapered holes 182 and plastic pin 150 is fitted within holes 182 and has its ends 151 formed under heat to conform to the contours of holes 182. End cap 86 thus can be rotated with resulting longitudinal movement, but cannot be removed. By rotating end cap 86, the operating states shown in FIGS. 6 and 8 can be attained. As shown in FIG. 6, end portion 52 of spring 50 is in contact with terminal 32 of battery 26 and body portion 64 of second spring 60 is in contact with shoulder 56 of spring 50, thereby illuminating lamp 28. Rotation of end cap 86 results in movement along a helical path to the operating state of FIG. 8, wherein lamp 28 is not illuminated because spring 60 has been decompressed, taking end portion 52 out of contact with battery terminal 32. End cap 84 of casing 80 remains freely removable, access to lamp 28 and batteries 26 thus being maintained.

The second modified form of the preferred embodiment, shown generally at 220 in FIG. 9, includes a second form of switch. Casing cylinder 82 has external helical threads 282 and end cap 86 has mating helical threads 286. Spring 50 is secured to end cap 86 at 260 for rotation, and rotation of end cap 86 moves spring 50 longitudinally from the operating state of FIG. 9 to that of FIG. 10. The end cap 86 of the secnd modified form of the preferred embodiment thus functions to compress and decompress the springs, thereby acting as a switch, as in the first modified form of the preferred embodiment.

Figures 11, 12, 13, 14, 15:
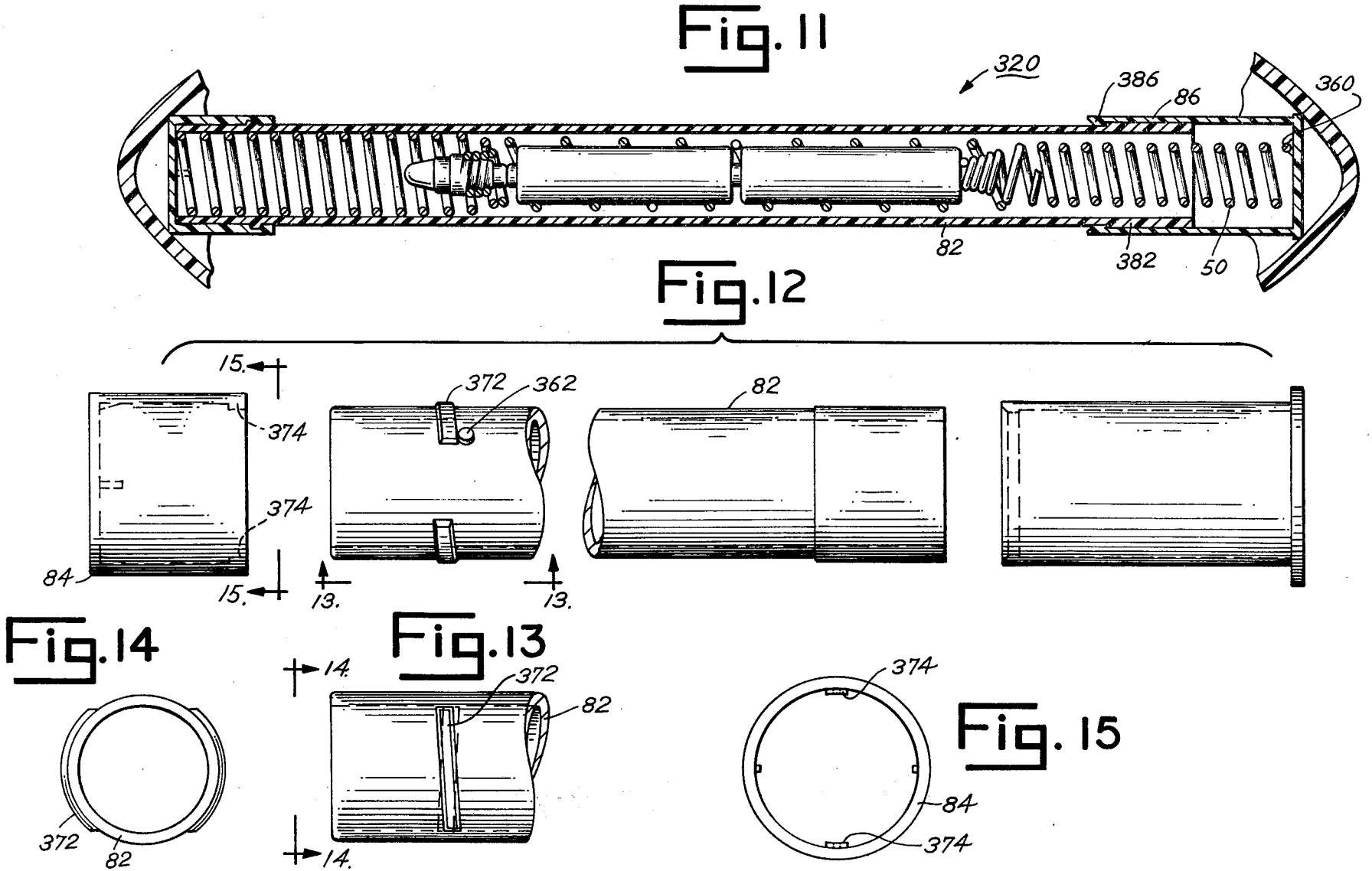
FIG. 11 is a longitudinal cross-sectional view of a third modified embodiment of the present invention.
FIG. 12 is a broken plan view of the casing of the embodiment of FIG. 11.
FIG. 13 is a partial plan view of the cylinder depicted in FIG. 12, taken along longitudinal line 13—13 of FIG. 12.
FIG. 14 is an end view of the portion of cylinder depicted in FIG. 13, taken along line 14—14 of FIG. 13.
FIG. 15 is an end view of the end cap depicted in FIG. 12, taken along line 15—15 of FIG. 12.

A third modified form of the present invention is shown in FIG. 11 at 320. Casing cylinder 82 has an enlarged end 382 and end cap 86 has ring 386 integrally formed therein, end cap 86 thus snapping into place on casing cylinder 82. Spring 50 is secured to end cap 86 at 360.

As shown in FIG. 12, casing cylinder 82 also has a plurality of ribs 372 formed integrally therewith and spaced about its circumference, said ribs being formed along helical lines, as shown in FIGS. 12, 13 and 14. End cap 84 has a plurality of tabs 374 formed integrally therewith and spaced about its interior, as shown in FIG. 15, tabs 374 being adapted to engage ribs 372 when end cap 84 is placed on casing cylinder 82. Stop 362 on casing cylinder 82 is provided for one of tabs 374 to lock against, end cap 84 thus being lockable into place on casing cylinder 82.

Thus a preferred embodiment of the present invention and three modified forms thereof have been described. It should be apparent to those having skill in the art that other modifications and embodiments of the present invention can be made. For example, multiple units could be used in the same casing by placing in serial order a first helical spring shaped like spring 50, a second helical spring shaped like spring 60, a third helical spring shaped like spring 50, a fourth helical spring shaped like spring 60 and a fifth helical spring shaped like spring 70. The preferred embodiment is therefore to be considered as illustrative and not restrictive, the scope of the present invention being measured by the appended claims. All embodiments within the range of equivalency of the claims are intended to be embraced therein.

What is claimed is:

1. In a play ball having a hollow interior and walls which allow light to pass therethrough from said hollow interior, the improvement of apparatus for illuminating said play ball, said apparatus utilizing lamp means having two electrical lamp terminal means and battery means having two electrical battery terminal means, said apparatus comprising, in combination:

means connecting said battery means in series with said lamp means including, (i) first electrically conducting compressible means for contacting one of said battery terminal means of said battery means;

(ii) second electrically conducting compressible means for securing said lamp means and simultaneously contacting one of said lamp terminals means, the other of said lamp terminal means being contacted with the other of said battery terminal means, said second compressible means also simultaneously contacting said first compressible means;

third compressible means; and a translucent and electrically insulating casing for encapsulating said lamp means, said battery means and said first, second and third compressible means, said casing having opposed end pieces, said first, second and third compressible means being compressed between said opposed end pieces in serial order, whereby the lamp means and battery means are supported in said casing and whereby a series circuit for the flow of electricity is provided from said battery means, through said lamp means, through said second compressible means, through said first compressible means and hence to said battery means.

2. The apparatus of claim 1 wherein said battery means is cylindrical with opposed battery ends, said battery terminal means being opposed battery terminals secured on said opposed battery ends, said second compressible means being generally cylindrical and defining a hollow cylindrical space for retaining said cylindrical battery means.

3. The apparatus of claim 1 wherein said second compressible means defines a hollow cylindrical space for retaining the battery means, said second compressible means having opposed ends, one of said opposed ends including a first opening connected with said hollow cylindrical space; and, wherein said first compressible means includes an end portion projecting into the first opening to simultaneously contact one of the battery terminal means and said second compressible means.

4. The apparatus of claim 3 wherein the other of said opposed ends defines a second opening into said hollow cylindrical space, said other of said lamp terminal means making contact with said other battery terminal through said second opening.

5. The apparatus of claim 1 wherein said lamp means is a lamp with a bulb and a body, one of said lamp terminal means being helical threads defined on said body, said second compressible means having coils for mating with said helical threads to simultaneously secure said lamp and contact said lamp terminal means.

6. The apparatus of claim 1 wherein said first compressible means is a first helical spring, said second compressible means is a second helical spring, and said third compressible means is a third helical spring.

7. The apparatus of claim 6 wherein said first and said second helical springs are substantially identical.

8. The apparatus of claim 1 further comprising, in combination, switch means for connecting and disconnecting said series circuit.

9. The apparatus of claim 1 wherein one of said end pieces is an end cap which is adapted to be at least partially removed for at least partially decompressing said second compressible means, whereby said first compressible means is moved out of said contact with said one of said battery terminal means and said series circuit is disconnected.

10. The apparatus of claim 1 further comprising: means for limiting movement of said first compressible means to prevent total removal thereof.

11. The apparatus of claim 10 wherein said first compressible means includes adjacent coils, and said means for limiting movement of said first compressible means includes a pin in said casing, said pin passing between said adjacent coils.

12. The apparatus of claim 1 wherein said casing includes a casing cylinder and a removable end cap, said casing cylinder having helical threads defined thereon, said end cap having mating helical threads defined thereon and further having means for securing said first compressible means to said end cap.

13. The apparatus of claim 1 further comprising, in combination, locking means for locking at least one of said end caps to said casing.

* * * * *